United States Patent [19]

Avery, Jr.

[11] 4,384,789

[45] May 24, 1983

[54] BLENDER

[75] Inventor: Hugh E. Avery, Jr., Hitchcock, Tex.

[73] Assignee: Allied Industries, Houston, Tex.

[21] Appl. No.: 313,955

[22] Filed: Oct. 22, 1981

[51] Int. Cl.[3] ..... B01F 5/00

[52] U.S. Cl. ..... 366/340; 222/1; 222/145; 222/464; 222/478; 366/341; 366/348

[58] Field of Search ..... 366/1, 9, 32, 41, 14, 366/15, 76, 77, 154, 177, 181, 192, 193, 336–341, 348, 349; 222/1, 145, 464, 478, 564; 414/267, 268; 138/38, 40, 42; 137/896; 48/180 R, 180 B

[56] References Cited

U.S. PATENT DOCUMENTS

| | | | |
|---|---|---|---|
| 151,034 | 5/1874 | Knox | 366/340 |
| 413,720 | 10/1889 | Henderson . | |
| 1,960,797 | 5/1934 | Sackett . | |
| 2,174,348 | 9/1939 | Damond . | |
| 2,433,684 | 12/1947 | Damond . | |
| 2,455,572 | 12/1948 | Evans | 366/336 |
| 2,779,510 | 1/1957 | Wilson et al. | 222/193 |
| 2,805,802 | 9/1957 | Strong | 222/564 |
| 2,907,501 | 10/1959 | Laird | 222/485 |
| 3,029,986 | 4/1962 | Horn et al. | 222/478 |
| 3,076,582 | 2/1963 | Arcement | 222/464 |
| 3,094,243 | 6/1963 | Haugen | 222/1 |
| 3,158,362 | 11/1964 | Seifarth . | |
| 3,414,164 | 12/1968 | McKay | 222/145 |
| 3,423,076 | 1/1969 | Jacobs et al. | 366/337 |

*Primary Examiner*—Philip R. Coe
*Assistant Examiner*—Timothy F. Simone
*Attorney, Agent, or Firm*—Lahive & Cockfield

[57] ABSTRACT

Apparatus for blending free-flowing particulate material. The blender includes a hopper having a central blending tube disposed therein. The blending tube has axially and circumferentially spaced apart openings sized to pass the particulate material into the interior of the blending tube. Disposed within the blending tube are a plurality of baffles which create imperforate, annular areas above the openings. Also disposed within the hopper are a series of circumferentially cascading weir plates which divide the hopper into a plurality of compartments. Each of the compartments communicates with at least one of the openings in the blending tube. In a preferred embodiment the baffles are spaced apart unevenly along the axis of the blending tube so that the openings to the interior of the tube at a particular level service substantially equal volumes of the particulate material in the hopper. In this embodiment the topmost baffle has a lower open area substantially equal to the imperforate annular areas. The sum of this open area and all of the imperforate annular areas is approximately equal to the cross-sectional area of the blending tube. The combination of the central blending tube and circumferentially cascading weir plates results in a blender having superior mixing capabilities.

7 Claims, 5 Drawing Figures

BLENDER

BACKGROUND OF THE INVENTION

This invention relates to blenders and more particularly to method and apparatus for thoroughly blending particulate or granular materials.

As storage bins or hoppers are filled with granular or particulate material, it often happens that an inhomogeneous distribution of material occurs. There may be several reasons for this result. In the first place, as material flows into a hopper, the material beneath the inlet nozzle piles up at the so-called angle of repose of the material. In this case the larger particles often roll down the peak toward the sides of the hopper, leaving the finer particles in the central region. Inhomogeneity can also occur when the hopper is filled with different batches of the same material because of variations in composition of individual batches. When material is drawn off through an outlet at the bottom of the hopper, the material flows from the region directly above the nozzle. Thus, the material which is drawn from the hopper as needed will not be representative of the average characteristics of the material in the hopper.

Prior art attempts at a solution to this segregation problem typically included placing a perforated blending tube within the hopper. Such a tube has openings spaced apart along its axis which allow material from all levels within the hopper to enter the tube. The lower portion of the blending tube communicates with the outlet nozzle so that a more nearly homogeneous mixture of the material issues from the outlet of the hopper. Another known blending apparatus includes cylindrical weirs whose heights decrease from the center of the hopper outwardly. In such a device the discharge nozzle communicates with each of the segments created by the cylindrical weirs so that material is sampled from various radial positions within the hopper. Although the known apparatus discharges a more nearly homogenous mixture of the granular material than would be the case with a simple hopper with a bottom outlet, there is room for considerable improvement in the mixing capabilities of storage bins.

It is an object of the invention, therefore, to provide method and apparatus for effecting a more thorough mixing of particulate material as it discharges from a hopper.

It is a further object to provide such apparatus which is simple of construction and inexpensive to use and maintain.

It is a still further object of the invention to provide apparatus for effective blending of very large lots of particulate material.

SUMMARY OF THE INVENTION

The apparatus according to the present invention which achieves the foregoing objects includes a hopper for containing particulate material. This hopper features an inlet port at its top, a substantially cylindrical section, and a downwardly converging lower section terminating in a discharge port. A blending tube is disposed within the hopper with its lower end communicating with the discharge port. This blending tube includes axially and circumferentially spaced apart openings sized to pass the particulate material into the interior of the blending tube. A plurality of conical baffles are disposed within the tube so as to create an imperforate annular area above the openings. Also disposed within the hopper are circumferentially cascading weir plates which extend substantially radially outwardly from the centrally located blending tube. These weir plates divide the hopper into a plurality of compartments, each of the compartments communicating with at least one of the openings in the blending tube.

In a preferred embodiment the openings within the blending tube and their associated conical baffles are separated unevenly along the axis of the blending tube so that the openings at a particular level service substantially equal volumes of the particulate material within the hopper. In this embodiment the topmost one of the conical baffles has a lower open area substantially equal to one of the imperforate annular areas created by the baffles. The sum of this open area and all of the imperforate annular areas is approximately equal to the cross-sectional area of the blending tube.

BRIEF DESCRIPTION OF THE DRAWING

The invention disclosed herein may be better understood with reference to the following drawing of which.

DESCRIPTION OF THE PREFERRED EMBODIMENT

Figure 1:
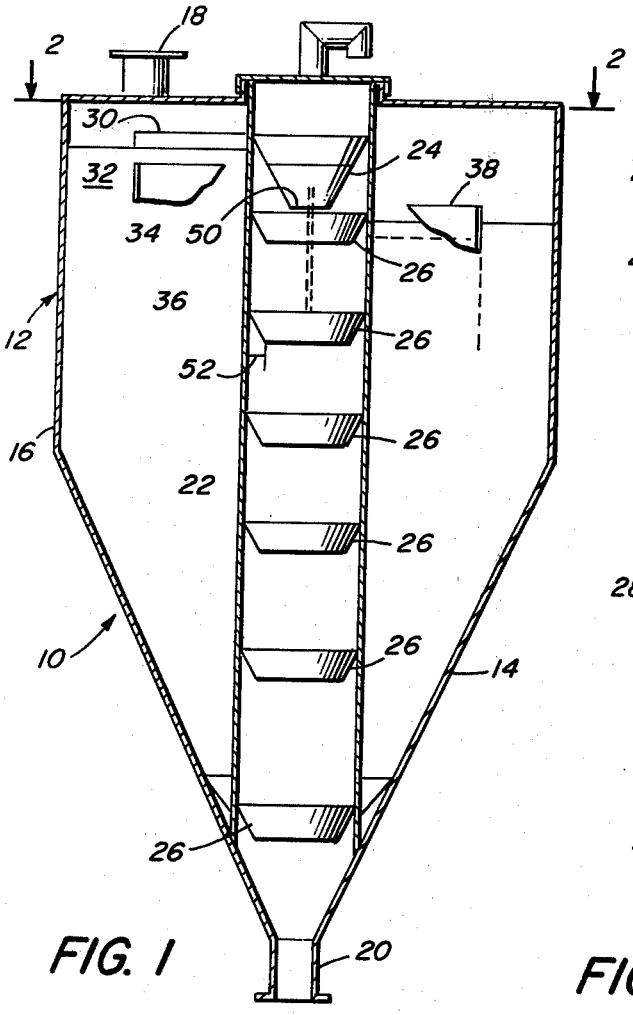
FIG. 1 is a cross-sectional view of the blending apparatus disclosed herein.
Figure 3:
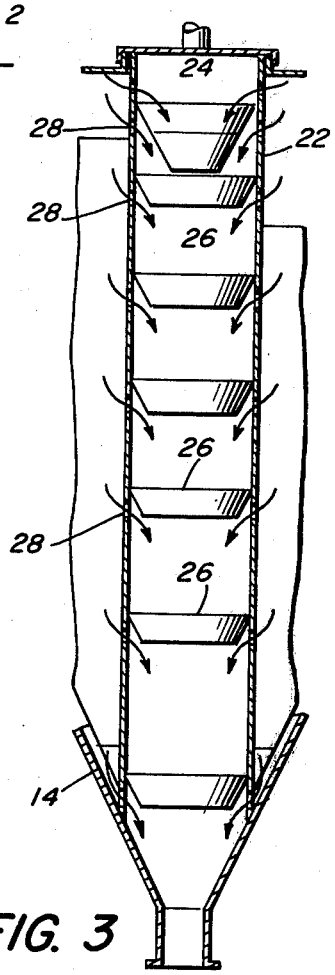
FIG. 3 is a cross-sectional view of the blending tube disposed within the blender of the present invention.

With reference first to FIG. 1, a blending apparatus designated generally at 10, includes a hopper 12 including a lower converging section 14 and a cylindrical section 16. The hopper 10 also includes an inlet port 18 which receives the particulate or granular material to be stored in the hopper 12. The particulate material is subsequently discharged through a discharge port 20. Disposed within the hopper 12 is a blending tube 22. Disposed within the blending tube 22 is a topmost baffle 24 and a plurality of lower baffles 26. As can be seen in FIG. 3, disposed beneath and adjacent to the topmost baffle 24 and the lower baffles 26 are openings 28 through which the particulate material passes into the interior of the blending tube 22.

Figure 4:
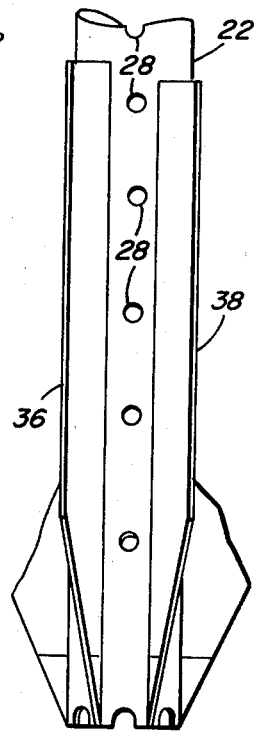
FIG. 4 is a view, partly broken away, of the blending tube of the present invention.
Figure 2:
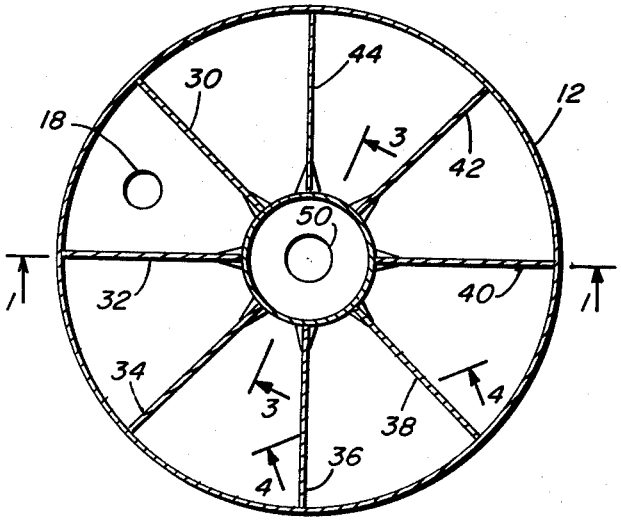
FIG. 2 is a cross-sectonal view taken along the lines 2—2 of FIG. 1.
Figure 5:
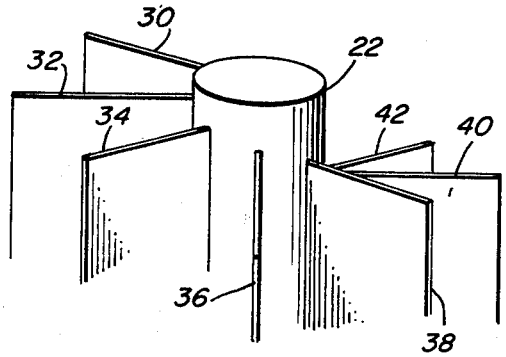
FIG. 5 is a perspective view illustrating the cascading weirs of the present invention.

With reference now to FIGS. 1 and 2, a plurality of cascading weir plates 30–44 are disposed in the hopper 12. The weir plate 30 is the tallest with the succeeding ones decreasing progressively in height, as can be seen clearly in FIG. 5. The weir plates 30–44 divide the hopper 12 into a plurality of compartments. As shown in FIG. 4, the compartments communicate with the interior of the blending tube 22 through the openings 28 included between a pair of the weir plates 36 and 38. Similar openings 28 are included between the other pairs of weir plates.

With reference now to FIGS. 1 and 3, it will be seen that the separation between the baffles 26 located within the lower converging section 14 is unequal. In particular, the separation is such that the volume of particulate material serviced by a particular level of openings 28 and the associated baffle 26 is the same at all levels.

Thus, because of the converging nature of the hopper 12, the lowermost openings and baffles are more widely separated than the ones above it. Because equal volumes of particulate material are serviced by each row of the openings 28, the homogeneity of the particulate material discharged through the discharge port 20 is improved.

The conical baffles 26 effectively shield the openings 28 so that the particulate material in the hopper 12 may flow into the blending tube 22 at all elevations. To insure that material is able to enter the openings 28 at all levels, even under choke-flow operation in which the blending tube 22 is completely filled, a novel relationship among the baffles and the blending tube cross-sectional area is maintained. Specifically, with reference to FIGS. 1 and 2, the area of the lower opening in the baffle 24, represented by the numeral 50, when added to the sum of the imperforate annular areas 52 created by the baffles 26, is made equal to the cross-sectional area of the blending tube 22. By maintaining this relationship, material is able to flow into the blend tube 22 at all of the levels of the openings 28 to assure thorough mixing. This relationship assumes that material flows into the blending tube through the vent openings located above the topmost baffle 24 as well as through the lower openings 28. If there is no flow above the baffle 24, the sum of the areas need not equal the blending tube cross-sectional area. In the particular embodiment illustrated in FIG. 1, the open area represented by the numeral 50 and each of the imperforate annular areas 52 would have an area of approximately one-seventh of the cross-sectional area of the blend tube 22 since there are six baffles 26 and one lower opening 50 in the baffle 24. It is to be understood that more or fewer baffles may be used.

The operation of the blending apparatus 10 will now be discussed with reference to FIGS. 1–5. Particulate material is supplied to the hopper 12 through the inlet port 18. The inlet port 18 is located above and between the weir plates 30 and 32. The weir plate 30 is the highest of the weir plates. Because the weir plate 32 is lower than the weir plate 30, when material has filled the compartment between the weir plates 30 and 32, material will begin to spill over the weir plate 32 into the compartment between the weir plates 32 and 34. Once this compartment is filled, the material spills over into the next compartment. This process continues all the way around the hopper 12. It is to be noted that each of the compartments may be filled separately from outside of the hopper 12 by providing additional inlet ports 18 above and between the other pairs of weir plates. In such a situation, the weir plates can be the same height rather than cascading since material will enter the region between each of the compartments from outside of the bin. As the various compartments around the bin 12 are filled, the material flows through the openings 28 into the blending tube 22. When the discharage port 20 is opened, the particulate material will flow out of the blending tube 22 and additional material will flow into the blending tube 22 through the openings 28. Material will thus enter the tube 22 at all levels. In this way the particulate material within the hopper 12 is thoroughly blended as it exits through the discharge port 20.

It is thus seen that the objects of this invention have been attained in that there has been disclosed a blending apparatus having superior blending capabilities. This result is accomplished by the combination of the cascading weir plates creating a plurality of circumferentially spaced apart compartments within the bin 12 in combination with the central blend tube including internal baffles and axially spaced apart openings to the interior of the blending tube.

SUMMARY OF THE ADVANTAGES AND NON-OBVIOUSNESS OF THE INVENTION

The superior blending capabilities of the apparatus disclosed herein is accomplished through the combination of two blending modes. Cascading weir plates divide the hopper into a plurality of compartments. As particulate material flows into the hopper, the compartments are filled sequentially so that variations in the particulate material entering the hopper are circumferentially distributed. As stated above, each compartment between a pair of the cascading weir plates can be filled separately from outside by providing inlet ports communicating with each of the compartments. As material is withdrawn from the apparatus, further blending and mixing is accomplished by means of the centrally located blending tube having axially spaced apart openings leading to its interior. Material therefore enters the blend tube at all levels, even under choke-flow conditions. Prior art blenders for particulate material do not teach or suggest the novel arrangement disclosed in this application.

Representative of prior art blending apparatus are U.S. Pat. No. 3,490,655 to Legget, and U.S. Pat. No. 3,029,986 to Horn. Both of these patents disclose blenders having a centrally located blending tube having holes or perforations permitting the material to flow to the interior of the tube. Neither of these references, however, employs circumferentially cascading weir plates to provide an initial blending before material is drawn off through a discharge port. U.S. Pat. No. 1,960,797 to Sackett discloses a storage bin having radially cascading cylindrical members disposed within the bin. This apparatus, however, does not employ a central blending tube as disclosed herein. None of these references, therefore, achieves blending using the two separate blending modes, disclosed herein, namely mixing circumferentially around the hopper and vertically along the length of a central blending tube.

While this invention has been described with reference to particular embodiments, it will be appreciated by those skilled in the art that additions, deletions, modifications and substitutions, or other changes not specifically described may be made which will fall within the scope of the appended claims.

What is claimed is:

1. Apparatus for blending free-flowing particulate material comprising:

(1) a hopper for containing said particulate material, said hopper including an inlet port at its top, a substantially cylindrical central section, and a downwardly converging lower section terminating in a discharge port;

(2) a blending tube disposed within said hopper, its lower end communicating with said discharge port, said tube including axially and circumferentially spaced apart openings sized to pass said particulate material into the interior of said tube;

(3) a plurality of conical baffles, each baffle disposed within said tube to create an imperforate annular area above said openings; and (4) circumferentially cascading weir plates disposed substantially radially within said hopper to divide said hopper into a plurality of compartments, each said compartment communicating with at least one of said openings in said tube.

2. The apparatus of claim 1 wherein said openings and associated conical baffles are spaced away unevenly along the axis of said blending tube whereby the openings at a particular level service substantially equal volumes of said particulate material within said hopper.

3. The apparatus of claim 1 wherein the topmost one of said conical baffles has a lower open area substantially equal to one of said imperforate annular areas, the sum of said open area and all of said imperforate annular areas being approximately equal to the cross-sectional area of said blending tube.

4. Apparatus for blending free-flowing particulate material comprising:

(1) a hopper for containing said particulate material, said hopper containing an inlet port at its top, a substantially cylindrical central section, and a downwardly converging lower section terminating in a discharge port;

(2) a blending tube disposed within said hopper, its lower end communicating with said discharge port, said tube including axially and circumferentially spaced apart openings sized to pass said particulate material into the interior of said tube;

(3) a plurality of conical baffles, each baffle disposed within said tube to create an imperforate annular area above said openings; and (4) circumferentially cascading weir plates disposed substantially radially within said hopper to divide said hopper into a plurality of compartments, each said compartment communicating with at least one of said openings in said tube, and wherein said openings and associated conical baffles are spaced apart unevenly along the axis of said blending tube whereby the openings at a particular level service substantially equal volumes of said particulate material within said hopper, and further wherein the topmost one of said conical baffles has a lower open area substantially equal to one of said imperforate annular areas, the sum of said open area and all of said imperforate annular areas being approximately equal to the cross-sectional area of said blending tube.

5. Method for blending free-flowing particulate material comprising:

(1) providing a hopper for containing said particulate material, said hopper including an inlet port at its top, a substantially cylindrical central section, and a downwardly converging lower section terminating in a discharge port;

(2) disposing a blending tube within said hopper, its lower end communicating with said discharge port, said tube including axially and circumferentially spaced apart openings sized to pass said particulate material into the interior of said tube;

(3) disposing a plurality of conical baffles within said tube to create an imperforate annular area above said openings; and (4) disposing circumferentially cascading weir plates substantially radially within said hopper to divide said hopper into a plurality of compartments, each said compartment communicating with at least one of said openings in said tube, whereby said particulate material is thoroughly blended upon discharge from said discharge port.

6. The method of claim 5 wherein said openings and associated conical baffles are spaced apart unevenly along the axis of said blending tube, whereby the openings at a particular level service substantially equal volumes of said particulate material within said hopper.

7. The method of claim 5 wherein the topmost one of said conical baffles has a lower open area substantially equal to one of said imperforate annular areas, the sum of said open area and all of said imperforate annular areas being approximately equal to the cross-sectional area of said blending tube.

* * * * *